United States Patent [19]

Drori

[11] 4,153,027

[45] May 8, 1979

[54] FUEL INJECTION PUMPING APPARATUS

[75] Inventor: Moshe Drori, East Twickenham, England

[73] Assignee: C.A.V. Limited, Birmingham, England

[21] Appl. No.: 829,875

[22] Filed: Sep. 1, 1977

[51] Int. Cl.[2] ..... F02M 39/00

[52] U.S. Cl. ..... 123/139 AQ; 417/462

[58] Field of Search ..... 123/139 AQ, 139 AT, 123/140 R; 417/462

[56] References Cited

U.S. PATENT DOCUMENTS

| | | | |
|---|---|---|---|
| 2,845,915 | 8/1958 | Frick | 123/140 R |
| 3,936,232 | 2/1976 | Mowbray | 123/139 AQ X |
| 3,943,903 | 3/1976 | Skinner | 123/140 R |

*Primary Examiner*—Edgar W. Geoghegan

[57] ABSTRACT

A fuel pumping apparatus for supplying fuel to an internal combustion engine includes an axially movable member urged in one direction against the action of a governor spring by means of a centrifugal weight. A reaction member for the pivot of the weight bears against one member of a dashpot which includes resilient means in the form of a spring acting in opposition to the force exerted by the governor spring. A valve controlled passage including a ball element allows substantially unrestricted flow of liquid into the dashpot chamber when the latter is increased in volume by the action of the spring but a restricted leakage path is provided to control the reduction in volume of the dashpot chamber as the force exerted by the governor spring and the weights increases. The axial setting of the member controls the quantity of fuel which is supplied to an internal combustion engine.

11 Claims, 2 Drawing Figures

FUEL INJECTION PUMPING APPARATUS

In the specification of my U.S. Pat. application Ser. No. 722,403, now U.S. Pat. No. 4,041,920, which is a continuation of my U.S. patent application Ser. No. 598,129 now abandoned there is described and claimed a fuel injection pumping apparatus for supplying fuel to internal combustion engines and of the kind comprising an injection pump, a feed pump for supplying fuel under pressure to the injection pump, an axially movable member disposed in a surrounding body, an adjustable orifice defined by the member and body the size of said orifice determining the amount of fuel supplied to the engine at each injection stroke by the injection pump, a pivotal centrifugal weight acting on one end of the member and urging the member in an axial direction to reduce the size of said orifice, a governor spring acting to urge the member against the action of said weight, operator adjustable means for varying the force exerted by said spring whereby the weight, spring and orifice together constitute a governor to control the speed of the associated engine in accordance with the setting of the operator adjustable means, a reaction member for the pivot of said weight, resilient means, said resilient means acting to urge the reaction member and pivot in opposition to said governor spring and a dashpot acting to limit the rate of movement of the reaction member against the action of said resilient means when the force exerted by the governor spring is increased.

With such an apparatus when the engine is operating at low speed and the operator effects movement of said means to increase the force exerted by the governor spring, there is initially an increase in the amount of fuel supplied to the engine at each injection stroke, as allowed by the inward movement of the weight. This is followed by a gradual increase in the amount of fuel supplied as the components of the dashpot collapse under the increased force exerted. This gradual increase in the amount of fuel supplied enables the engine to accelerate without overfuelling which if it did occur, would lead to excessive smoke in the engine exhaust.

The resilient means acts to restore the components of the dashpot to their original state when the operator adjustable means is moved to reduce the force exerted by the governor spring. It has been found however that on sudden acceleration of the engine following deceleration with insufficient time for the dashpot to refill results in undue smoke because the dashpot action as described cannot take place.

The object of the invention is to provide such an apparatus in a simple and convenient form.

According to the invention in an apparatus of the kind specified the chamber of the dashpot has in communication therewith a valve controlled passage through which liquid can enter the dashpot chamber at a substantially unrestricted rate.

Figure 1:
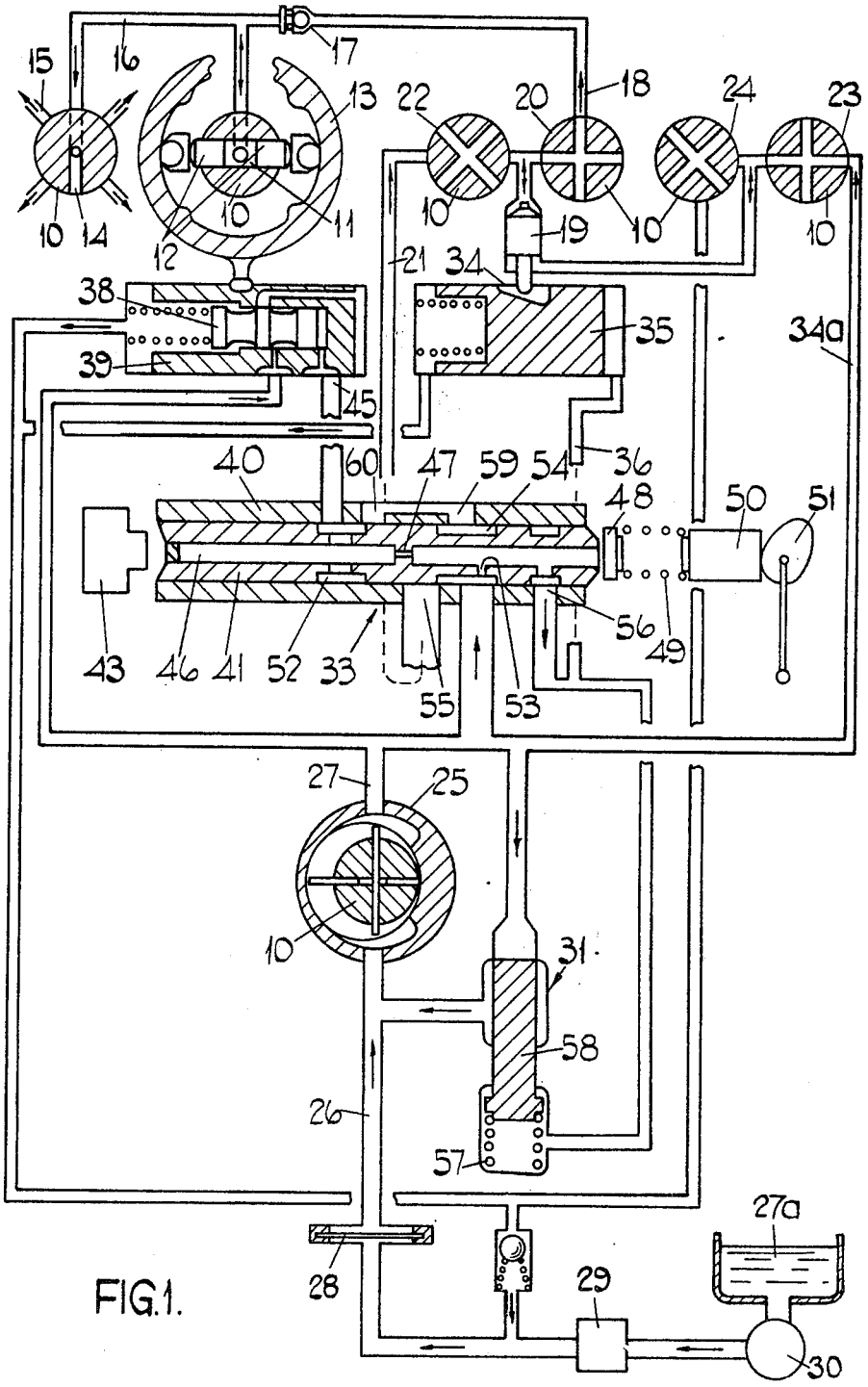
Figure 2:
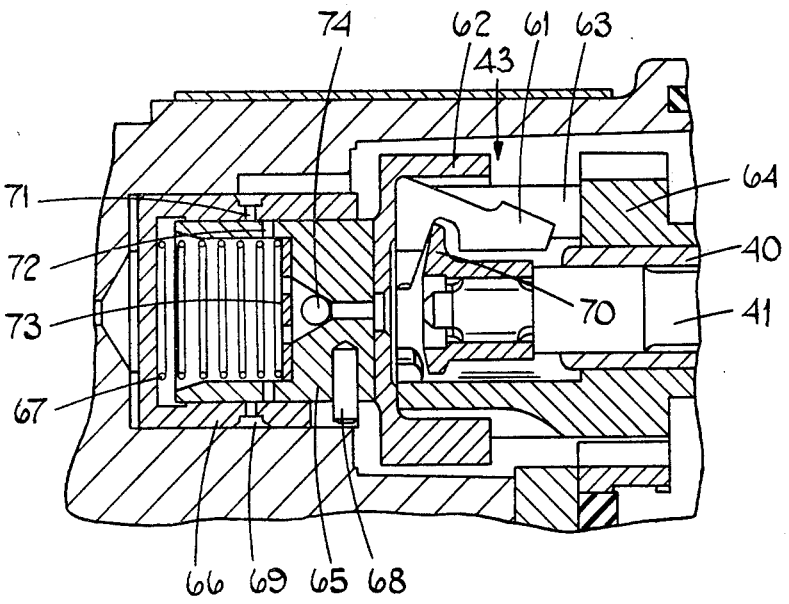

An example of a fuel pumping apparatus in accordance with the invention will now be described with reference to the accompanying drawings:

FIG. 1 is a diagrammatic illustration of the fluid circuit of the apparatus, and FIG. 2 is a sectional side elevation of a portion of the apparatus seen in outline only in FIG. 1.

Referring to FIG. 1 of the drawings the apparatus comprises a body part in which is journalled a rotary cylindrical distributor member 10 which is shown in the drawing in seven parts each part corresponding to a particular section along the distributor member. The distributor member is adapted to be driven in timed relationship with the engine with which the apparatus is associated and at one point in the distributor member there is formed a transversely extending bore 11 in which is mounted a pair of reciprocable pumping plungers 12. Surrounding the distributor member at this point is an annular cam 13 having on its internal periphery, a plurality of pairs of diametrically disposed cam lobes. The cam lobes through the intermediary of rollers respectively, act upon rotation of the distributor member, to move the pumping plungers 12 inwardly thereby to expel fuel contained within the transverse bore 11. The pumping plungers 12 together with the cam lobes constitute an injection pump.

The transverse bore 11 communicates with a passage 16 extending within the distributor member and at one point this passage communicates with an outwardly extending delivery passage 14 which registers in turn as the distributor member rotates, with a plurality of outlet ports 15 formed in the body part. These ports communicate in use, with injection nozzles respectively disposed to direct fuel into respective combustion chambers of the associated engine.

The passage 16 communicates by way of a check valve 17 with a passage 18 and this passage can be brought into communication with one end of a bore containing a slidable shuttle 19 by means of a rotary valve 20. The aforesaid one end of the bore at other times as will be explained, can be placed in communication with a feed passage 21 by means of a rotary valve 22.

The other end of the bore containing the shuttle 19 can be placed in communication with a source of fuel at a high pressure by means of a rotary valve 23 or with a source of fuel at low pressure by means of a rotary valve 24. The valves 20, 22, 23 and 24 since they are in part formed by the distributor member, are actuated in timed relationship with the engine. In addition also mounted on the distributor member is a feed pump 25 of the rotary vane type. The pump has an inlet 26 and an outlet 27 and the inlet communicates with a supply of fuel **27*a* by way of a pair of filter units 28, 29 and a lift pump 30 the latter being provided to ensure the supply of fuel to the feed pump. The output pressure of the feed pump is controlled by a relief valve 31 the function of which will be described later. The outlet 27 of the feed pump communicates by way of a passage 34*a* with the valve 23** the purpose of which has already been explained.

The operation of the apparatus thus far described is as follows. With the parts of the apparatus in the positions shown in FIG. 1 fuel is flowing from the outlet of the feed pump by way of the valve 23 to said other end of the bore containing the shuttle 19. The shuttle 19 is therefore moved inwardly towards said one end of the bore and fuel is displaced from this end of the bore and flows by way of the rotary valve 20 and the check valve 17, to the passage 16 and in particular to the bore 11. The plungers in this bore are moved outwardly by an amount dependent upon the quantity of fuel displaced by the shuttle 19.

During continued rotation of the distributor member the passage 14 is brought into register with an outlet port 15 and during this time the plungers 12 are moved inwardly and fuel is displaced from the bore to the appropriate engine cylinder. Also during this time the rotary valves 20 and 23 are closed and the valves 22 and 24 are open so that fuel flows to said one end of the bore containing the shuttle 19 which therefore moves outwardly towards the other end of the bore. The quantity of fuel which is supplied to the bore containing the shuttle is controlled by a metering valve 33 which will be described later and this therefore determines the quantity of fuel which is supplied to the injection pump during a filling stroke and thereby the amount of fuel which is supplied to the associated engine at each injection stroke of the injection pump. During continued rotation of the distributor member the process described is repeated and fuel is supplied to the engine cylinders in turn.

It will be appreciated that the shuttle 19 determines the maximum quantity of fuel which can be supplied by the apparatus at each injection stroke. This maximum quantity of fuel is varied in accordance with the speed of the engine to provide shaping of the maximum fuel characteristic and for this purpose the maximum excursion of the shuttle is made to vary in accordance with the speed of the engine. The shuttle 19 is provided with an extended end portion which can co-operate with a cam surface 34 formed on a spring loaded piston 35. The piston is movable against the action of its spring by means of fuel under pressure supplied to one end of the cylinder by way of a passage 36. The pressure of the fuel which is supplied to the passage is dependent on the speed at which the apparatus and associated engine is driven and the way in which it is derived will be explained later. The effect is that the axial setting of the piston 35 will be dependent upon the speed of the associated engine and thereby the allowed excursion of the shuttle 19 will also be dependent upon the engine speed.

There is also provided a fluid pressure operable member in the form of a servo piston 39 and this is connected to the cam ring 13 by means of a peg. The piston 39 is provided with a bore in which is mounted a spring loaded servo valve 38 which controls the admission or escape of fuel pressure to and from one end of the cylinder containing the piston 39. The fuel under pressure is obtained from the outlet 27 of the feed pump and the servo valve 38 is subjected to a pressure existing in a conduit 45. As this pressure increases the servo valve 38 will be moved against the action of its spring loading towards the left as seen in FIG. 1 and the servo piston 39 will follow this movement thereby moving the cam ring 13 angularly and altering the timing of injection of fuel to the engine.

Considering now the metering valve 33. This comprises a sleeve 40 which is fixed within the body of the apparatus. Located within the sleeve is an axially movable rod member 41 which at one end is acted upon by a centrifugal weight mechanism which will be described in greater detail with reference to FIG. 2 but which includes a pair of centrifugal weights which are rotated at a speed directly proportional to the speed at which the engine is driven.

Extending axially within the rod member is a bore 46 which at its end adjacent the weight mechanism is closed by a plug. Moreover, intermediate its end, the bore is provided with a restrictor 47. At its opposite end the bore 46 is obturated by a valve member 48 the latter being loaded by a coiled compression spring 49. The opposite end of the coiled compression spring is engaged by operator adjustable means comprising a movable abutment 50 and the axial setting of the abutment and thereby the force which is exerted by the spring 49 can be adjusted by means of a cam 51 connected to a control pedal of a vehicle of which the associated engine forms part. The portion of the bore 46 which is closed by the plug, is in constant communication with the conduit 45 this being achieved by a circumferential groove 52 formed on the rod member and which is in constant communication with a port in the sleeve 40 and communicating with the conduit 45. The other end of the bore 46 is in communication by way of a restrictor 53, with a further circumferential groove 54 formed on the rod member. Formed in the sleeve is a port 55 which communicates with the passage 21 and the port 55 is positioned so that the groove 54 can have partial registration therewith so as to define an adjustable orifice through which fuel can flow to the injection pump from the feed pump, the outlet 27 of which is in constant communication with the circumferential groove 54.

The right hand portion of the bore 46 is in constant and unrestricted communication by way of a further circumferential groove and a port 56, with the passage 36 which communicates with one end of the cylinder containing the piston 35. In addition the port 56 is in communication with the chamber containing the spring 57 which loads the valve member 58 of the relief valve 31. The spring 57 urges the valve member 58 towards the closed position in which no fuel is spilled from the outlet of the feed pump. Finally there is formed in the sleeve, a pair of spaced and communicating ports 59, 60. The port 59 is in constant communication with the circumferential groove 54 and the port 60 can register to a varying degree depending upon the axial position of the rod member 41, with the circumferential groove 52. The port 60 and circumferential groove 52 constitute a restricted orifice.

In operation, the axial setting of the rod 41 is dependent upon the speed at which the engine is driven and as the engine speed increases the weights in the weight mechanism 43 will effect movement of the rod member 41 towards the right as seen in FIG. 1. This movement of course takes place against the action of the spring 49. As explained the force exerted by the spring 49 can be varied and if the spring force is increased then for a given engine speed, the rod member will move towards the left against the action of the weights. As a result of such movement, the effective size of the orifice which is in series with the passage 21 and the outlet of the feed pump is increased and therefore more fuel will be supplied to the engine. The fuel pressure existing in the right hand end of the bore 46 is by virtue of the restrictor 53 and the valve member 48 which is subjected to the force exerted by the weights, proportional to the square of the speed at which the engine is driven. In practice the valve member 48 will be lifted slightly from the end of the bore 46 so that flow of fuel will occur through the restrictor 53.

The pressure in the right hand end of the bore 46 is allowed to act upon the valve member 58 of the relief valve 31 and in so doing enhances the force exerted by the spring 57. The output pressure of the feed pump will therefore have a value represented by the law $N^2+K$ where N is the speed at which the apparatus is driven and K is a constant depending upon the spring 57. With the arrangement described if the operator should suddenly effect in increase in the force exerted on the spring 49 then the rod member 41 will immediately move towards the left by virtue of the fact that the weights can collapse inwardly as will be explained and this will cause a rapid increase in the amount of fuel supplied to the engine. At low engine speeds this can cause problems with temporary overfuelling of the engine whereas at higher speeds this problem does not arise.

Turning now to FIG. 2, this shows in greater detail the construction of the weight mechanism 43. It will be seen that the rod member 41 has mounted thereon a part which defines an outwardly extending flange 70 against which the toe portions of the weights 61 engage. The heel portions of the weights pivot about a complementary surface formed in a cage 62 which is of generally cup-shaped form but which has extended portions 63 which are connected to a gearwheel 64 mounted about an extension of the sleeve 40. The gearwheel 64 is conveniently coupled by gearing to the distributor member 10 so that the cage rotates at a speed proportional to the engine speed.

The cage 62 constitutes a reaction member for the weights and it engages a thrust member 65 which is of generally cylindrical form and which is slidably accommodated within a cup-shaped member 66 located within a recess in the body portion of the apparatus. The thrust member 65 defines a recess in which is located a coiled compression spring 67 which biasses the thrust member against the action of the weights. The thrust member 65 and the cup-shaped member 66 are restrained against relative angular movement by means of a pin 68 which is accommodated within an axial slot formed in the wall of the cup-shaped member 66.

Formed in the outer peripheral surface of the cup-shaped member 66 is a circumferential groove 69 which communicates with the interior of the apparatus this being in communication with the inlet of the feed pump 25 by way of a spring loaded non-return valve. Moreover, extending inwardly from the circumferential groove 69 are a plurality of ports 71 which are able as will be explained, to register with similarly disposed ports 72 formed in the wall of the thrust member 65 and communicating with the chamber which accommodates the spring 67.

At the base of the recess formed in the thrust member 65 there is mounted an apertured plate 73 which coveniently is retained in position by the action of the spring 67. Moreover, carried by the thrust member is a non-return valve including a ball 74 which can co-operate with a seating and the non-return valve controls the flow of liquid from the interior of the apparatus to the chamber accommodating the spring, the ball closing against the seating to prevent flow out of the chamber.

The thrust member 65 and the cup-shaped member 66 constitute the components of a dashpot with the chamber accommodating the spring constituting the dashpot chamber. Restricted leakage of fuel from this chamber is allowed by way of clearances in the facing walls of the thrust member and cup-shaped member. In general, fuel flowing from the chamber will flow by the shortest path between the ports 71 and 72.

The strength of the coiled compression spring 67 is such that at low engine speeds i.e. up to about 400 rpm, the force exerted by the spring 67 is greater than that which is developed by the spring 49 when the engine is running with the governor in a position of equilibrium. As a result the cage 62 is moved to its maximum extent towards the right and it assumes the position in which it is shown in FIG. 2. In this equilibrium position, the weights 61 will have moved outwardly a small extent from the position in which they are shown in FIG. 2. If now the operator moves the throttle pedal so as to obtain maximum engine speed, the immediate effect will of course be to increase the force exerted by the spring 49 and this in turn will cause axial movement of the rod member 41 so that the weights are moved to their innermost position i.e. the position in which they are shown in FIG. 2. As a result a sudden increase in the quantity of fuel which is supplied to the engine takes place but further axial movement of the rod member 41 is temporarily halted. It will be appreciated however that with the throttle pedal fully depressed the force exerted by the spring 49 will be greater than that exerted by the spring 67 and as a result a gradual collapse of the dashpot will occur. During collapse of the dashpot the rod member 41 will move under the action of the spring 49 and there will be a progressive increase in the amount of fuel supplied to the engine until the normal governing action takes place. The rate of increase of fuel depends upon the size of the leakage path from the spring chamber and this can be chosen to give the desired rate of increase.

As the thrust member 65 and cup-shaped member 66 move relative to each other against the action of the spring 67 a point will be reached at which the ports 71 and 72 are brought into communication with each other and then the dashpot action will cease. The strength of the spring 67 can be arranged so that the dashpot action as described can take place up to any desired speed of the associated engine.

At increased engine speeds with the governor in a position of equilibrium, the force exerted by the governor spring 49 will be greater than the force exerted by the spring 67 and as a result the latter spring will be compressed to the extent determined by the contact of the thrust member and the cup-shaped member. As a result there will be no relative movement of these two components as described when the rod member 41 is moved to increase the supply of fuel to the associated engine.

During compression of the spring 67 the ball 74 remains in contact with its seating and the flow of fuel out of the aforesaid chamber is always through the aforesaid restricted passage. If the force exerted by the governor spring 49 is now reduced to the extent that the force exerted is less than that which is exerted by the spring 67, two events take place. With the reduction in the force exerted by the governor springs, the weights 61 will move outwardly to their maximum extent and this will effect movement of the rod member 41 towards the right thereby to effect a partial reduction in the quantity of fuel supplied to the engine. This is what happens with the mechanism described in the specification of the application to which reference has previously been made. With the present apparatus the second event is that the thrust member 65 is immediately moved towards the right by the action of the spring 67. During this movement the one way valve permits flow of fuel into the aforesaid chamber. The movement towards the right of the thrust member 65 means also that the weight mechanism is moved towards the right and also the rod member 41. As a result the quantity of fuel flowing to the engine is further decreased.

The fact that the dashpot chamber can fill quickly means that following deceleration of the engine, the dashpot is available to limit the rate of increase of fuel as described during subsequent acceleration of the engine.

I claim:

1. A fuel injection pumping apparatus for supplying fuel to an internal combustion engine comprising an injection pump, a feed pump for supplying fuel under pressure to the injection pump, an axially movable member disposed in a surrounding body, an adjustable orifice defined by the member and body the size of said orifice determining the amount of fuel supplied to the engine at each injection stroke by the injection pump, a pivotal centrifugal weight acting on one end of the member and urging the member in an axial direction to reduce the size of said orifice, a governor spring acting to urge the member against the action of said weight, operator adjustable means for varying the force exerted by said spring whereby the weight, spring and orifice together constitute a governor to control the speed of the associated engine in accordance with the setting of the operator adjustable means, a reaction member for the pivot of said weight, resilient means, said resilient means acting to urge the reaction member and pivot in opposition to said governor spring, and a dash-pot acting to limit the rate of movement of the reaction member against the action of said resilient means when the force exerted by the governor spring is increased, a valve controlled passage in communication with the chamber of the dash-pot through which liquid can enter the dash-pot chamber at a substantially unrestricted rate.

2. An apparatus according to claim 1 in which said dash-pot includes a first member which forms a thrust member engaged by said reaction member.

3. An apparatus according to claim 2 in which said valve controlled passage is formed in said first member.

4. An apparatus according to claim 3 in which the dash-pot includes a second member of cup-shaped form, the first member being slidable within the second member, the first and second members defining the chamber of the dash-pot.

5. An apparatus according to claim 4 in which the resilient means is in the form of a coiled compression spring which is positioned in said chamber and acts between the members.

6. An apparatus according to claim 5 including a restricted leakage path from said chamber.

7. An apparatus according to claim 6 in which the restricted leakage path is constituted by a clearance between the two members.

8. An apparatus according to claim 7 including ports in the walls of the first and second members and which are brought into communication with each other after a predetermined relative movement of the two members against the action of the spring.

9. An apparatus according to claim 8 in which the port in the second member is in communication with a drain.

10. An apparatus according to claim 8 including means for preventing relative angular movement of the members.

11. An apparatus according to claim 1 in which the valve of the valve controlled passage includes a ball and a seating for engagement by the ball to prevent flow through said passage.

* * * * *